US006248054B1

(12) United States Patent
Berger et al.

(10) Patent No.: US 6,248,054 B1
(45) Date of Patent: Jun. 19, 2001

(54) CENTRIFUGAL SEPARATION APPARATUS HAVING A MECHANISM TO LIMIT ROTATION OF THE BOWL DURING A CLEANING MODE

(75) Inventors: Jeffrey L. Berger, Zionsville; Scott Behrens, Noblesville, both of IN (US)

(73) Assignee: U.S. Centrifuge, Indianapolis, IN (US)

( * ) Notice: Subject to any disclaimer, the term of this patent is extended or adjusted under 35 U.S.C. 154(b) by 0 days.

(21) Appl. No.: 09/387,578

(22) Filed: Aug. 31, 1999

Related U.S. Application Data

(62) Division of application No. 09/057,076, filed on Apr. 8, 1998, now Pat. No. 6,126,587.

(51) Int. Cl.[7] ..... B04B 9/00; B04B 11/08

(52) U.S. Cl. ..... 494/55; 494/84

(58) Field of Search ..... 494/1, 7–9, 50–56, 494/58, 59, 67, 84; 210/372–377, 380.1

(56) References Cited

U.S. PATENT DOCUMENTS

| | | |
|---|---|---|
| 2,056,890 | 10/1936 | Pecker . |
| 2,056,891 | 10/1936 | Pecker . |
| 2,435,623 | 2/1948 | Forsberg . |
| 2,895,023 | 7/1959 | Blum . |
| 2,913,169 | 11/1959 | Wilsmann . |
| 3,226,016 | 12/1965 | Couper et al. . |
| 3,329,275 | 7/1967 | O'Conor . |
| 3,403,848 | 10/1968 | Windsor et al. . |
| 3,582,934 | 6/1971 | Zumbulsen . |
| 3,741,465 | 6/1973 | Lincoln . |
| 3,860,167 | 1/1975 | Lascoux . |
| 3,861,584 | 1/1975 | Dudrey . |
| 3,990,631 | 11/1976 | Schall . |
| 4,014,497 | 3/1977 | Spiewok et al. . |
| 4,046,317 | 9/1977 | Hein, Jr. . |
| 4,070,290 | 1/1978 | Crosby . |
| 4,155,503 | 5/1979 | Sears . |
| 4,214,179 | 7/1980 | Jacobson et al. . |
| 4,223,829 | 9/1980 | Bange . |

(List continued on next page.)

FOREIGN PATENT DOCUMENTS

| | | | | |
|---|---|---|---|---|
| 604906 | * | 9/1978 | (CH) | 494/55 |
| 884812 | * | 12/1961 | (GB) | 494/55 |
| 420347 | * | 3/1974 | (SU) | 494/55 |
| 441968 | * | 9/1974 | (SU) | 494/55 |

OTHER PUBLICATIONS

Brochure entitled "Basket Centrifuges Built for Tough Separation Applications", U.S. Centrifuge, Indianapolis, Indiana, 6 pages.

Spec Sheet entitled "Model A262", U.S. Centrifuge, Indianapolis, Indiana, 2 pages.

(List continued on next page.)

*Primary Examiner*—Charles E. Cooley
(74) *Attorney, Agent, or Firm*—Woodard, Emhardt, Naughton, Moriarty & McNett

(57) ABSTRACT

A centrifugal separator system for substantially separating a combination of material into a substantially pure solid portion and a substantially pure liquid portion. In one form of the centrifugal separator a plow blade assembly is rotatable relative to a bowl during a cleaning mode to dislodge adhered material from the inner surface of the bowl. The plow blade assembly being driven by a plow blade assembly motor that is pivoted into engagement with the plow blade assembly. One form of the centrifugal separator has an integral top discharge feed impeller/directing member. The delivery of material into the centrifugal separator is through a self-centering feed tube positioned above the bowl. The plow blade assembly having a plurality of plow blades oriented tangential to the outer diameter of the plow blade drive shaft.

14 Claims, 5 Drawing Sheets

U.S. PATENT DOCUMENTS

| | | | | |
|---|---|---|---|---|
| 4,416,655 | * | 11/1983 | Bennett . | |
| 4,522,620 | | 6/1985 | Leister . | |
| 4,978,331 | | 12/1990 | Luchetta et al. . | |
| 5,250,180 | * | 10/1993 | Chang | 494/56 |
| 5,342,282 | | 8/1994 | Letourneur . | |
| 5,356,367 | | 10/1994 | Carr . | |
| 5,362,293 | | 11/1994 | Romanauskas . | |
| 5,380,266 | | 1/1995 | Leung et al. . | |
| 5,425,698 | | 6/1995 | Carr . | |
| 5,454,777 | | 10/1995 | Ziems et al. . | |
| 5,527,258 | | 6/1996 | Leung et al. . | |
| 5,667,681 | | 9/1997 | Magrecki et al. . | |

OTHER PUBLICATIONS

Spec Sheet entitled "Model A242", U.S. Centrifuge, Indianapolis, Indiana, 2 pages.

* cited by examiner

CENTRIFUGAL SEPARATION APPARATUS HAVING A MECHANISM TO LIMIT ROTATION OF THE BOWL DURING A CLEANING MODE

The application is a divisional of Ser. No. 09/057,076 filed Apr. 8, 1998, now U.S. Pat. No. 6,126,587 which is incorporated herein by reference.

BACKGROUND OF THE INVENTION

The present invention relates generally, to the design and construction of a centrifugal separator apparatus for separating a composition into a substantially solid portion and a substantially fluid portion. More specifically, the present invention has one form wherein a pivoting plow motor assembly is moveable to engage a plow gear to drive a plow blade assembly. A bumper assembly allows the plow motor to reach a substantial torque before the plowing of the solid portion occurs. Although the present invention was developed for use in centrifugal separator systems, certain applications may be outside this field.

It is well known that in a centrifugal separator the separation of the solids and liquids in a contaminated fluid is accomplished by delivering the contaminated fluid to a high-speed rotating bowl. The high-speed rotation of the bowl creates centrifugal gravitational forces that cause the contaminated fluid to be displaced radially outward against the wall of the bowl. Since the bowl is rotating at a high rotational speed the solids tend to adhere to the bowl wall, while the substantially purified liquid exits through a discharge opening.

The centrifugal separator bowl must be periodically cleansed to remove the solids adhered to the bowl wall during the separation process. Failure to maintain the bowl in a dynamically balanced state and/or overloading with solid deposits can result in various problems. Such problems, for example, include: premature wear and failure of bushings, bearings, and seals; inefficient solid and liquid separation; overloading of the bowl motor drive; and, overloading the plow blade assembly drive motor. Prior designers of centrifugal separators have incorporated a mechanical plow blade within the bowl to remove accumulated deposits in an attempt to minimize problems associated with an over-load/unbalanced bowl.

One limitation associated with many prior centrifugal separator designs relates to the operation and configuration of the plow blade assembly. The plow blades extend generally radially from a center shaft, and therefore provide the same plow-action in either direction of rotation. The solids scraped from the bowl wall had a tendency to stick to the blades of the plow. Thus, it was often necessary to extend the clean cycle time in order to remove the solids from the blades. The extension of the clean cycle time is generally unacceptable because it increases the overall time required to process the liquid.

Even with a variety of earlier designs, there remains a need for an improved centrifugal separator apparatus. The present invention satisfies these needs, among others, in a novel and unobvious way.

SUMMARY OF THE INVENTION

One form of the present invention contemplates a centrifugal separator, comprising: a bowl for receiving a combination of liquid and solid therein; a drive spindle coupled to the bowl; a member rotatable within the bowl during a cleaning mode for dislodging at least a portion of the solid accumulated therein; a first motor coupled to the drive spindle for rotating the bowl during a separation mode to substantially separate the combination of liquid and solid; and a second motor moveable relative to the member so as to couple the second motor with the member and cause rotation of the member during the cleaning mode.

Another form of the present invention contemplates a centrifugal separator comprising: a bowl adapted for receiving liquids and solids, the bowl having a wall member; and a plow blade assembly disposed within the bowl, the plow blade assembly being rotatable relative to the wall member during a cleaning mode to remove solids accumulated on the wall member during a separation mode, the plow blade assembly including at least one plow blade that forms an angle of less than 90 degrees with the wall member.

Another form of the present invention contemplates a centrifugal separator, comprising: a bowl for receiving a composition of liquids and solids therein; a drive spindle coupled to the bowl for rotating the bowl during a high speed separation mode, the drive spindle having a first passageway formed therethrough; a drive member having a first end and an opposite other second end with a second passageway formed therethrough, the drive member disposed within the first passageway and rotatably coupled to the drive spindle; and a feed tube assembly including a mechanical housing rotatably mounted on an outer surface of the first end of the drive member, and a feed tube fixedly coupled to the mechanical housing and extending into the second passageway for delivering the combination of liquids and solids to the bowl.

Another embodiment of the present invention contemplates a centrifugal separator, comprising: a bowl for receiving a combination of liquid and solid therein; a drive spindle coupled to the bowl for rotating the bowl during a separation mode to substantially separate the combination of liquid and solid; a member disposed within and rotatable relative to the bowl during a cleaning mode for dislodging at least a portion of the solid accumulated therein; a bumper ring coupled to the drive spindle; and a bumper ring engaging member for engaging a portion of the bumper ring during the cleaning mode to prevent substantial rotation of the drive spindle and bowl.

One object of the present invention is to provide an improved centrifugal separator apparatus.

These and other objects will become more apparent from the following description of the preferred embodiments.

DESCRIPTION OF THE PREFERRED EMBODIMENT

Figure 1:
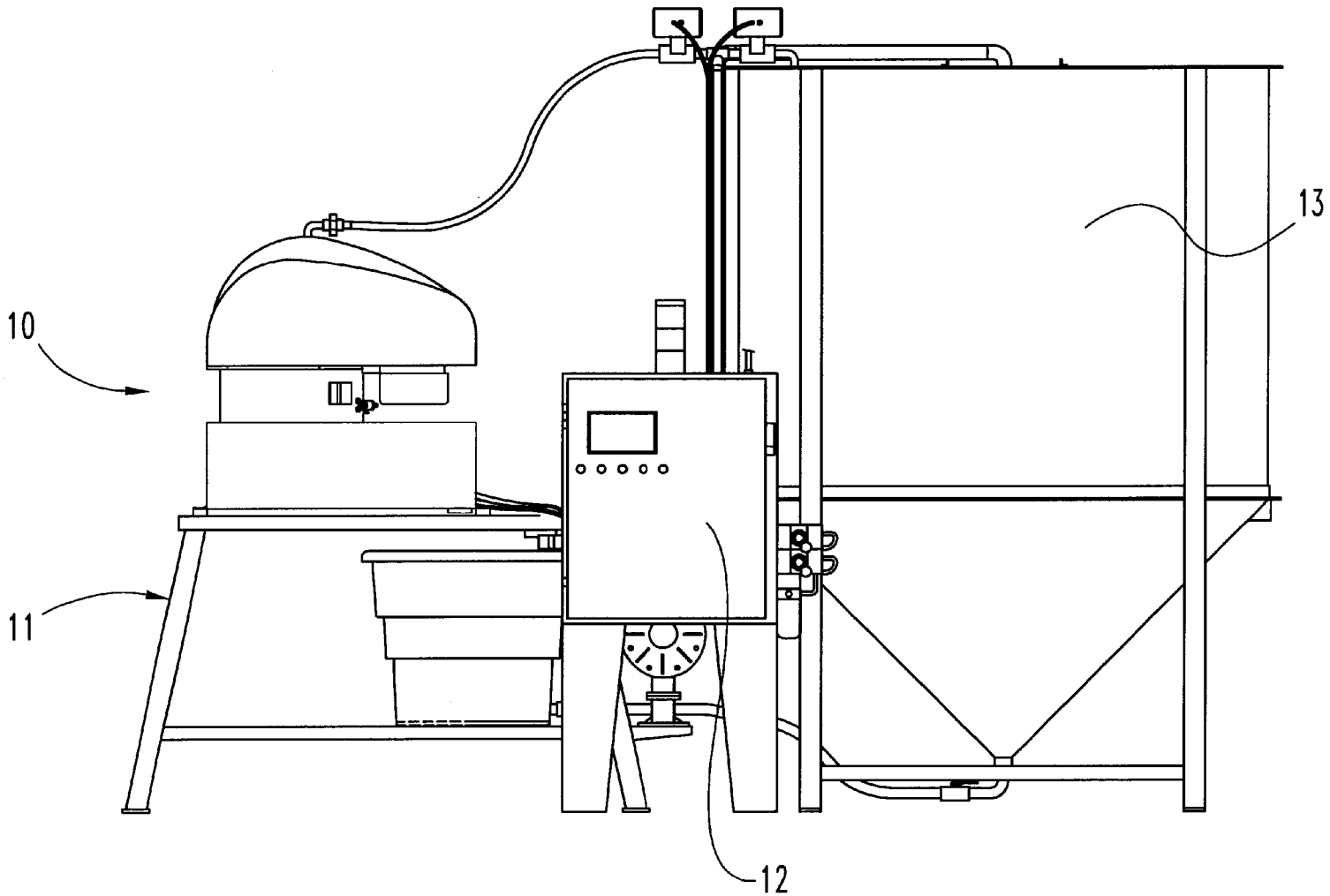
FIG. 1 is an illustrative side elevational view of one form of a centrifugal separator system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated a high-speed centrifugal separator 10 positioned on a stand 11 and disposed in fluid communication with a reservoir/tank 13. Further, the centrifugal separator is coupled in data communication with a controller 12. The reservoir/tank 13 is designed and constructed to hold a combination of material comprising fluids and solids. The composition of the fluid in the preferred embodiment is composed of a liquid and solid. In one form of the present invention the combination of material is pumped from the reservoir/tank 13 into the centrifugal separator 10 for subjection to high-speed centrifugal gravitational separation in a bowl. The combination of material is separated into a substantially "pure" liquid portion and a substantially "pure" solid portion. However, other techniques for delivering the combination of material to the centrifugal separator are contemplated herein. Further, in another embodiment a plurality of centrifugal separators operates in series so that the fluid output from one separator is processed in another separator.

Figure 2:
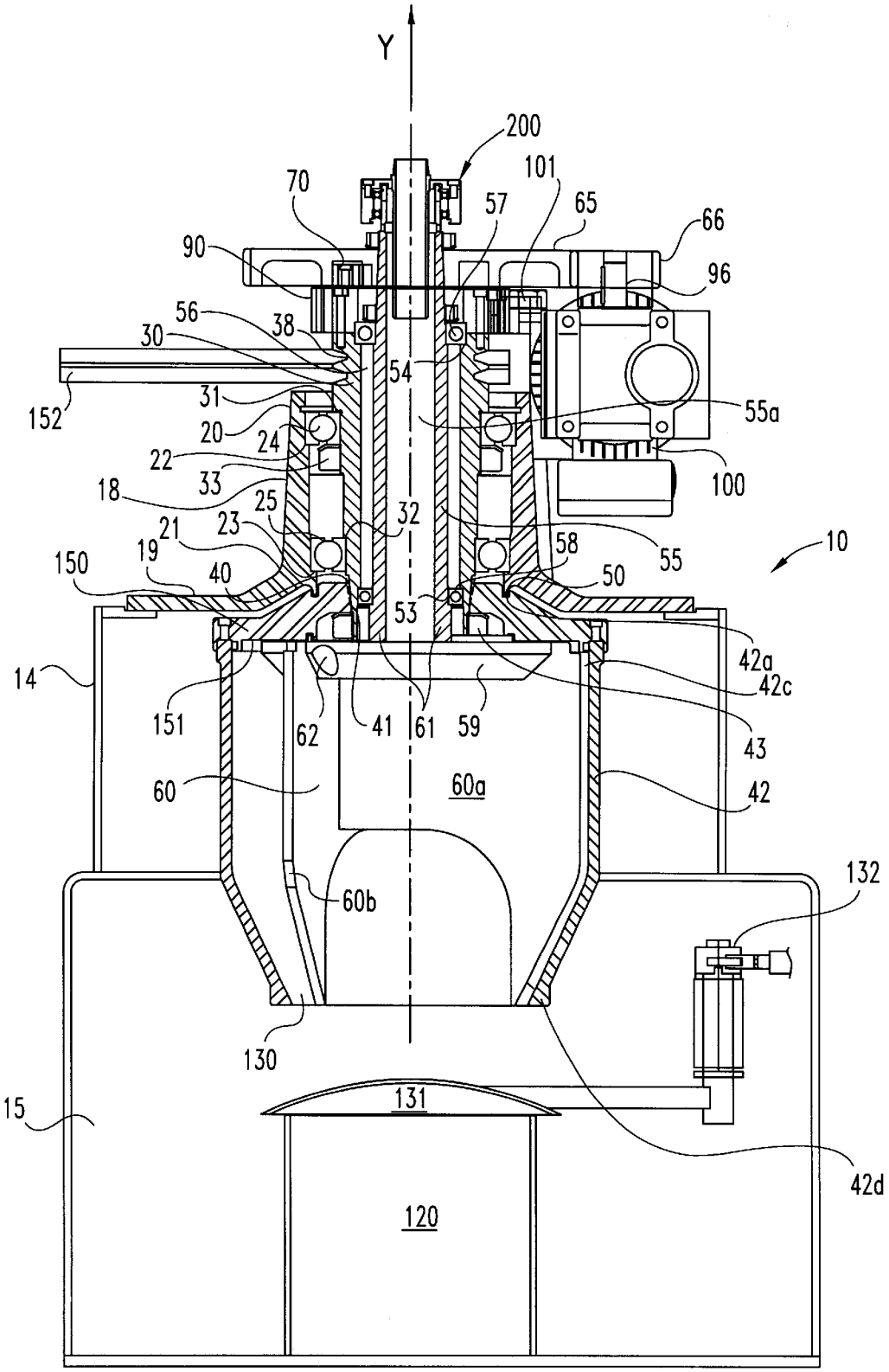
FIG. 2 is a sectional side elevational view of the centrifugal separator comprising a portion of the FIG. 1 centrifugal separator system.

Referring to FIG. 2, there is illustrated a side elevational view in section of the high-speed centrifugal separator 10. The centrifugal separator 10 includes a bowl 42 that rotates during a separation mode. The separation mode is a portion of the run cycle during which the bowl 42 is revolved at substantially high speeds to create centrifugal forces that act on the composition to separate the solids and liquids. Further, there is a clean mode wherein the solid material accumulated in the bowl is removed. In one form of the present invention, the bowl has a diameter in the range of about 10–18 inches, and more preferably is about 15 inches in diameter. The bowl is rotated in the separation mode at a speed in the range of 2,500–4,000 revolutions per minute (RPM), or more. Another form of the present invention contemplates a centrifugal separator having a 12–24 inch diameter bowl that rotates in a speed range of 1,500–3,800 RPM, or more. It is understood that the above material is not intended to be limiting and that generally other bowl sizes and rotational speeds are contemplated herein.

The centrifugal separator 10 includes a substantially rigid frame 14. Frame 14 is generally a fabricated metal structure that is believed within the contemplation of one of ordinary skill in the art. Other frame designs that have the necessary structural integrity to allow components to rotate within specified tolerances are believed known to a person of ordinary skill in the art. A fluid collection system 15 is positioned within frame 14 for receiving the substantially pure fluid exiting a discharge 130. In one form of the present invention, the collection system 15 is a fluid collection tank. The fluid discharge 130 is located at the bottom of the bowl 42. In the preferred embodiment fluid discharge opening 130 defines a substantially annular discharge opening. In an alternate embodiment, the fluid collection system 15 includes an inclined drain trough or other means to provide flow to a centralized point.

A main bearing housing 18 includes a radially outward extending portion 19 adapted for coupling to the frame 14. In a preferred embodiment the main bearing housing 18 is integrally formed and is substantially symmetric about a vertical centerline Y. More preferably, the main bearing housing 18 is formed of a cast material, such as steel. Additionally, the main bearing housing 18 is positioned above a bowl hub 150 of the bowl 42. A first bearing seat 22 is formed on a first end 20 of housing 18, and a first bearing 24 is positioned within the first bearing seat 22. A second bearing seat 23 is formed on a second end 21 of housing 18, and a second bearing 25 is positioned within second bearing seat 23. Preferably, bearings 24 and 25 are rolling element type bearings, and the bearings 24 and 25 are more preferably ball type bearings. The bearings 24 and 25 each include an outer bearing race that is fixedly coupled to the main bearing housing 18. Further, the bearings 24 and 25 are located axially above the bowl 42.

A main drive spindle 30 is positioned within and rotatable relative to the main bearing housing 18 and extends substantially parallel with the centerline Y. Main drive spindle 30 is a substantially rigid shaft having a first bearing seat 31 and a second bearing seat 32 formed therein. The bearing seats 31 and 32 are sized and located to be received by the inner bearing races of first bearing 24 and second bearing 25. A bearing keeper 33 is utilized to keep the first bearing 24 in place. A person of ordinary skill in the art realizes that the bearings 24 and 25 are coupled between the main drive spindle 30 and housing 18 to allow the main drive spindle 30 to efficiently rotate within the housing 18. The main drive spindle 30 is coupled to a drive mechanism for rotating the main drive spindle 30 about the centerline Y. The main drive spindle 30 is revolved by the drive mechanism at a high speed during a high-speed separation mode to substantially separate the liquid and solids. In the preferred embodiment the drive mechanism includes a rotatable flexible driven belt 152 that is coupled to the shaft of an electric drive motor (not shown). In one form of the present invention, main drive spindle 30 includes a belt-receiving portion 38 for receiving a portion of the driven belt 152 therein.

Main drive spindle 30 has a lower portion 40 that is sized to fit within a first aperture 41 formed in bowl hub 150 of bowl 42. A lock ring 43 is coupled to a part of lower portion 40 that is coupled to the bowl hub 150. Lock ring 43 is configured to hold main spindle 30 and bowl 42 together so that there is no substantial relative motion therebetween. Further, in a preferred form of the present invention, the bowl 42 is oriented such that it is rotatable around the vertical centerline Y. However, other methods of locking the main drive spindle 30 to the bowl 42 are believed within the contemplation of a person of ordinary skill in the art.

In one embodiment a labyrinth seal 50 may be positioned between the main bearing housing 18 and a portion 42*a* of the bowl hub 150. The labyrinth seal 50 forms a sliding substantially tight annular seal between the bowl 42 and the main bearing housing 18. In the preferred embodiment, labyrinth seal 50 includes an annular ring formed on the main bearing housing 18 which resides in a corresponding groove formed in a portion of rim 42*a*.

A substantially rigid plow blade drive shaft 55 extends through an aperture 56 formed in the main drive spindle 30. Plow blade drive shaft 55 is coupled to a first rolling element type bearing 57 that is positioned within a first bearing seat 54 formed in main drive spindle 30. In one form of the present invention, the bearing 57 is a ball type bearing. Additionally, plow blade drive shaft 55 has a second bearing seat 53 formed thereon for receiving a second rolling element type bearing 58. Thus, the plow blade drive shaft 55 is rotatable on first bearing 57 and second bearing 58 within the aperture 56 formed in main drive spindle 30. The plow blade drive shaft 55 extends from the main drive spindle 30 a distance so as to allow clearance between a bottom surface 151 of the bowl hub 150 of bowl 42. Further, in one embodiment the plow blade drive shaft extends a distance so as to provide an attachment surface for coupling each of the plow blades thereto.

The incoming combination of material is passed through the center aperture 55*a* of the plow blade drive shaft 55 and disbursed near a top portion 42*c* of the bowl 42. A fluid directing member/dam ring 59 is positioned directly adjacent to the incoming fluid flow. In a preferred form of the present invention, the fluid directing member/dam ring 59 is coupled with a second end 61 of the plow blade drive shaft 55. More preferably, the fluid directing member/dam ring 59 is integrally formed with the plow blade assembly 60. A fluid discharge opening 62 is positioned in the directing member/dam ring 59 so as to facilitate disbursing the fluid into the bowl 42. In one form, directing member/dam ring 59 includes a plurality of fluid discharge openings 62 for releasing the combination of material near the top portion 42*c* of the bowl 42. A more preferred form of the present invention comprises three fluid discharge openings 62 for releasing the combination having a substantially liquid portion and a substantially solid portion near the top portion 42*c* of bowl 42. Alternate embodiments of the present invention contemplate other numbers of fluid discharge openings 62 in the directing member/dam ring 59. In one embodiment, the feed impeller and directing member/dam ring 59 are integrated and located within the top portion 42*c* of the bowl, thereby minimizing the extension of structures into a central region of the bowl 42. The minimization of structures in the central region of the bowl minimizes the restrictions for the solids moving from the bowl during the cleaning mode.

Figure 3:
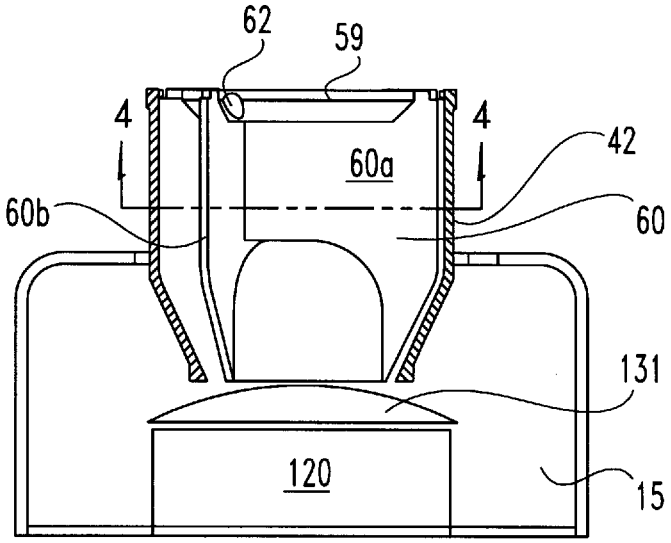
FIG. 3 is an enlarged sectional view of the plow blade assembly comprising a portion of the centrifugal separator of FIG. 2.
Figure 4:
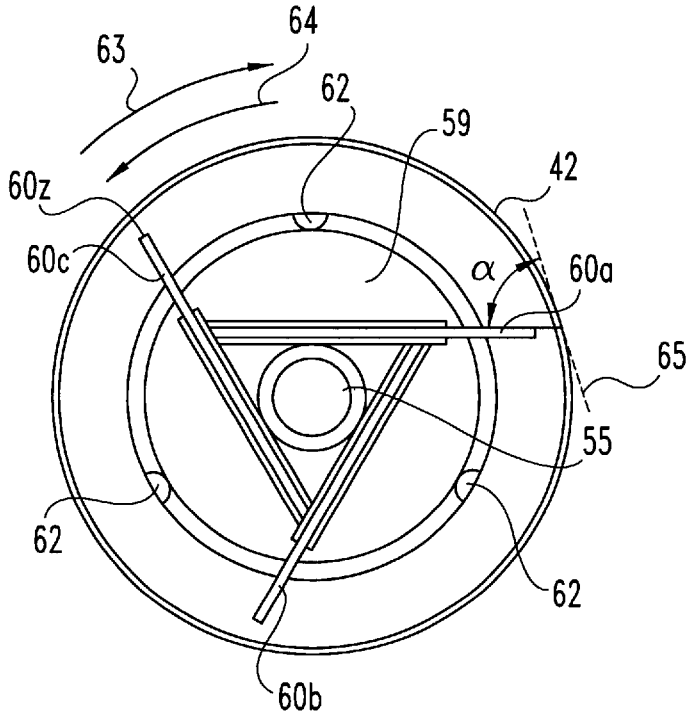
FIG. 4 is a sectional view taken along line 4—4 of the plow blade assembly of FIG. 3.

Referring to FIGS. 3 and 4, there is illustrated a plow blade assembly 60 including an integral directing member/dam ring 59. The plow blade assembly 60 comprises a plurality of plow blades 60*a*, 60*b* and 60*c*. The plow blades 60*a*, 60*b*, and 60*c* are coupled in a tangential relationship with the outer diameter of the plow blade drive shaft 55. Each of the plow blades 60*a*, 60*b* and 60*c* are coupled to the outer diameter of the shaft 55. It should be understood that the present invention contemplates any number of plow blades for plow blade assembly 60, so long as each of the blades is in a tangential relation with the outer diameter of the plow blade drive shaft 55. In the preferred embodiment, each of the plow blades are coupled with the directing member/dam ring 59.

Plow blade assembly 60 is disposed within bowl 42 in order to remove solids adhering to an inner wall member of the bowl during the cleaning mode. In one embodiment, an edge 60*z* of each of the plow blades 60*a*, 60*b* and 60*c* is spaced a distance from the inner wall of bowl 42. In one embodiment the minimum distance is 0.005 inches, and in a more preferred embodiment, the distance is about 0.050 inches. However, other spacings from the inner wall of the bowl 42 are contemplated including a substantially zero gap between the edge 60*z* of the respective plow blades 60*a*, 60*b* and 60*c*. The plow blades of the plow blade assembly 60 are preferably substantially rigid, erosion resistant, and capable of dislodging the solids adhering to bowl 42 during the cleaning mode.

The orientation of the plow blades 60*a*, 60*b* and 60*c* in tangential relation to the outer diameter of the plow blade drive shaft 55 causes an angle $\alpha$ to be formed between each blade and a reference line 65 which is tangent to the wall of bowl 42. The angle $\alpha$ is less than ninety degrees. The orientation of the individual plow blades enables the plow blade assembly 60 to provide two modes of plowing action. When rotating the plow blade assembly 60 in a direction indicated by arrow 63, the blades 60*a*, 60*b*, and 60*c* provide a scooping action for lifting material from the wall of bowl 42. When the plow blade assembly 60 is rotated in the opposite direction, indicated by arrow 64, the blades push the solids adhering to the wall of bowl 42. The rotation of the blade assembly in the direction of arrow 64 pushes the solids into a ball.

Referring back to FIG. 2, the bowl 42 includes a discharge opening 130 located at its bottom portion 42*d*. During the separation mode, opening 130 allows the substantially pure liquid to exit bowl 42 and pass into the storage tank 15. Further, during the separation mode the solid discharge chute 120 is blocked so as to prevent passage of material through the chute. Upon interruption of the separation mode and beginning of the cleaning mode a lid 131 is removed from the solid discharge chute 120. An actuation means 132 is utilized to mechanically actuate the lid 131 to either an open or a closed position. The plow blade assembly 60 is then rotated to remove the solids adhering to bowl 42 and the materials are allowed to pass into the chute 120. Typically, chute 120 is positioned over a solids storage container (not shown).

The belt 152 placed in notch 38 of main drive spindle 30 couples the main drive to the drive motor assembly (not shown). A clutch member 70 is included to mechanically couple main drive spindle 30 to plow blade drive shaft 55. This causes plow blade assembly 60 to rotate along with bowl 42 and no substantial relative movement therebetween is created during the separation mode. Clutch member 70 may be any type of clutch assembly known in the art, including centrifugal clutches, so long as it is operable to couple main drive spindle 30 and plow blade drive shaft 55 during the separation mode. A commonly owned U.S. Pat. No. 5,879,279, which is incorporated herein by reference, provides detail related to one form of the clutch member 70. A first toothed gear 65 is coupled to plow blade drive shaft 55 and a second toothed gear 66 is removably engageable with the first gear 65. Second gear 66 is coupled to a drive shaft 96 of plow motor 100. The rotation of second gear 66 relative to first gear 65 causes the plow blade assembly to rotate when the two gears are engaged and the plow motor 100 is energized.

Figure 5:
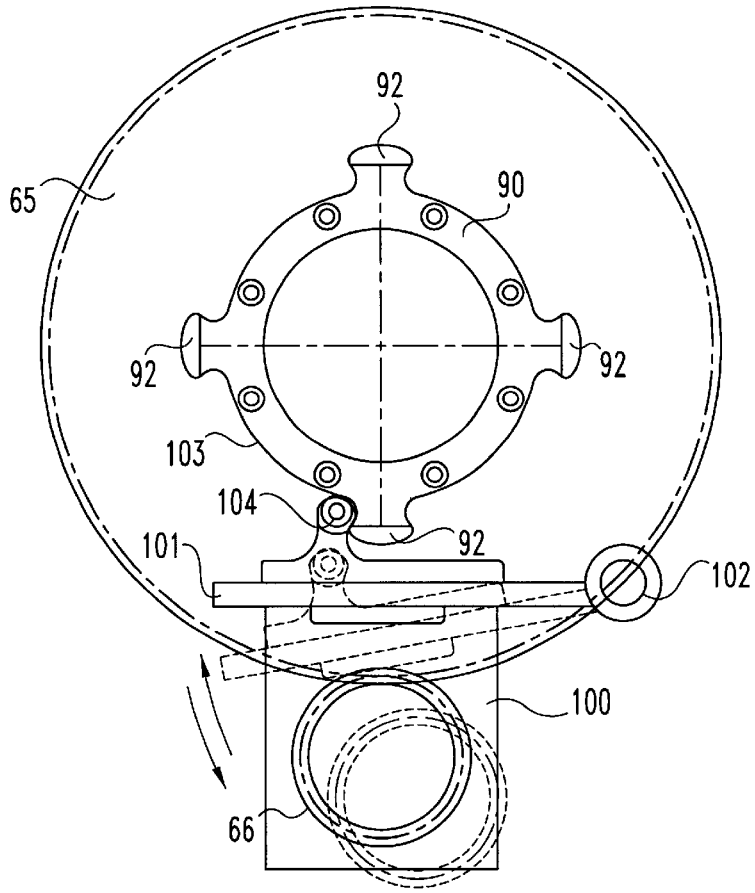
FIG. 5 is a view of the bumper ring assembly comprising a portion of the centrifugal separator of FIG. 2.

With reference to FIG. 5, there is illustrated the plow motor 100 coupled to a pivot member 101. In one form, pivot member 101 defines a structural plate that can pivot about a pivot pin 102 so as to allow the engagement and disengagement of the teeth of gears 65 and 66. The pivot pin 102 is coupled to a stationary portion of the centrifugal separator 10, such as, but not limited to frame 14 or main housing 18. When gears 65 and 66 are engaged, plow motor 100 is operable to turn drive shaft 96, which causes gears 65 and 66 to rotate plow blade drive shaft 55 and plow blade assembly 60 within bowl 42.

During the cleaning cycle, the plow blade assembly 60 rotates relative to the bowl 42. The plow blade assembly 60 and bowl 42 may initially rotate together during the cleaning cycle; the solids adhering to the inner bowl wall and plow blades may tend to initially hold the components together. In one embodiment, there is provided a means for facilitating relative movement between the bowl and the plow blade assembly. One means for facilitating relative motion between the components includes a bumper ring 90, which is coupled to the main drive spindle 30. In one embodiment the bumper ring 90 includes a plurality of bumper elements 92 protruding therefrom. Pivot plate 101 includes a bumper ring engaging element 104, which is configured to lockingly engage bumper elements 92. When the pivot plate 101 is pivoted so as to cause the teeth of gears 65 and 66 to mesh, an engaging element 104 is also pivoted so it is positioned in the path of the bumper elements 92 of the bumper ring 90. As the main drive spindle 30 rotates with the plow blade drive shaft 55, the engaging element 104 engages one of the bumper elements 92 in a locking relationship, thereby preventing further rotation of main drive spindle 30 and bowl 42 with respect to the plow blade assembly 60. The plow motor 100 will transmit its power through gear 65 and 66 to rotate the plow blade assembly 60 relative to the bowl 42, while the main drive spindle 30 is maintained in a stationary position by the interrelationship between the engaging element 104 and one of the bumper elements 92. In one embodiment, the interengagement between the engaging element 104 and one of the bumper elements 92 is such that it tends to hold the gears 65 and 66 together tighter as the torque applied to the gears increases, thus facilitating the gears being firmly engaged with one another and reducing toothwear.

In one form the bumper ring 90 includes four bumper elements 92 protruding therefrom, spaced 90 degrees apart, and integrally formed with sidewall 103. This spacing provides plow motor 100 an opportunity to reach a substantial torque prior to the engaging element 104 engaging one of the a bumper elements 92. Relative movement between plow blade assembly 60 and bowl 42 is facilitated by the engagement of one of the bumper elements 92 with the engaging element 104. It should be understood, however, the bumper ring 90 may be provided with any number of bumper elements 92, including a single bumper element. Alternative embodiments additionally contemplate other locking means between bumper ring 90 and pivot plate 101. For example, pivot plate 101 may include a pin protruding therefrom which is inserted into a slot formed on either bumper ring 90 or main spindle 30.

Figure 6:
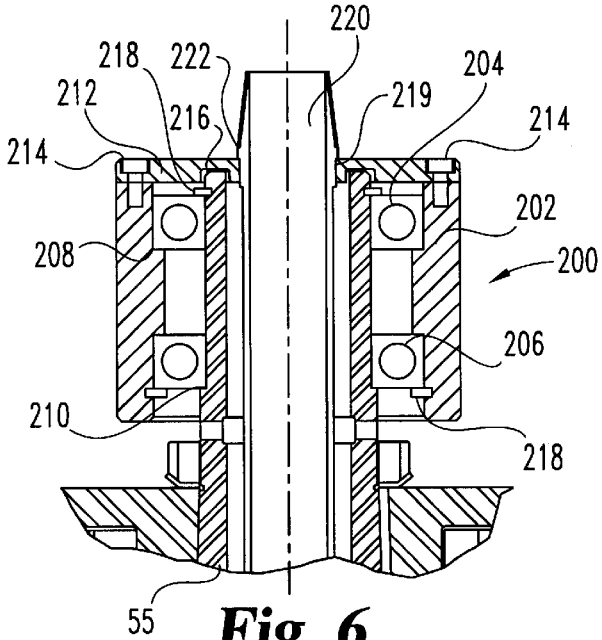
FIG. 6 is an enlarged view of a self-centering feed tube comprising a portion of the centrifugal separator of FIG. 2.

Referring now to FIG. 6, there is illustrated a feed tube assembly 200 for providing a passageway for the delivery of the combination of material to the centrifugal separator 10. In one form of the present invention the feed tube assembly 200 is self-centering within the aperture in the plow blade drive shaft 55. Assembly 200 includes a tube bearing housing 202, a first tube bearing 204 and a second tube bearing 206 mounted within the housing 202. The first tube bearing 204 and the second tube bearing 206 are coupled to the outer diameter of plow blade drive shaft 55. The tube bearing housing 202 includes a first bearing recess 208 for maintaining the positioning of first tube bearing 204, and a second bearing recess 210 is formed on the plow blade drive shaft 55 for maintaining the positioning of second tube bearing 206. A pair of snap rings 218 are positioned above and below the bearings 204 and 206 so as to maintain them in position. A cap 212 is coupled to bearing housing 202 with at least one cap pin 214. The cap 212 includes a recess 216 for receiving one end of the plow blade drive shaft 55. An aperture is defined in cap 212, the aperture is sized to allow passage of a feed tube 220 therethrough until a lip 222 on the feed tube engages the cap 212. When the lip 222 engages cap 212, the feed tube 220 is firmly positioned within aperture 219. The diameter of the aperture 219 and the outside diameter of the feed tube 222 are sized to provide a substantially tight fit.

The self-centering feed tube assembly 200 allows for the rotation of the plow blade drive shaft 55 about the feed tube 220. Further, the feed tube assembly 200 allows the positioning of feed tube 220 to be maintained in the center of plow blade drive shaft 55. The feed tube 220 is held by an external force applied thereto, and will not substantially migrate/cantilever from the desired location in the center of drive shaft 55.

Figure 7:
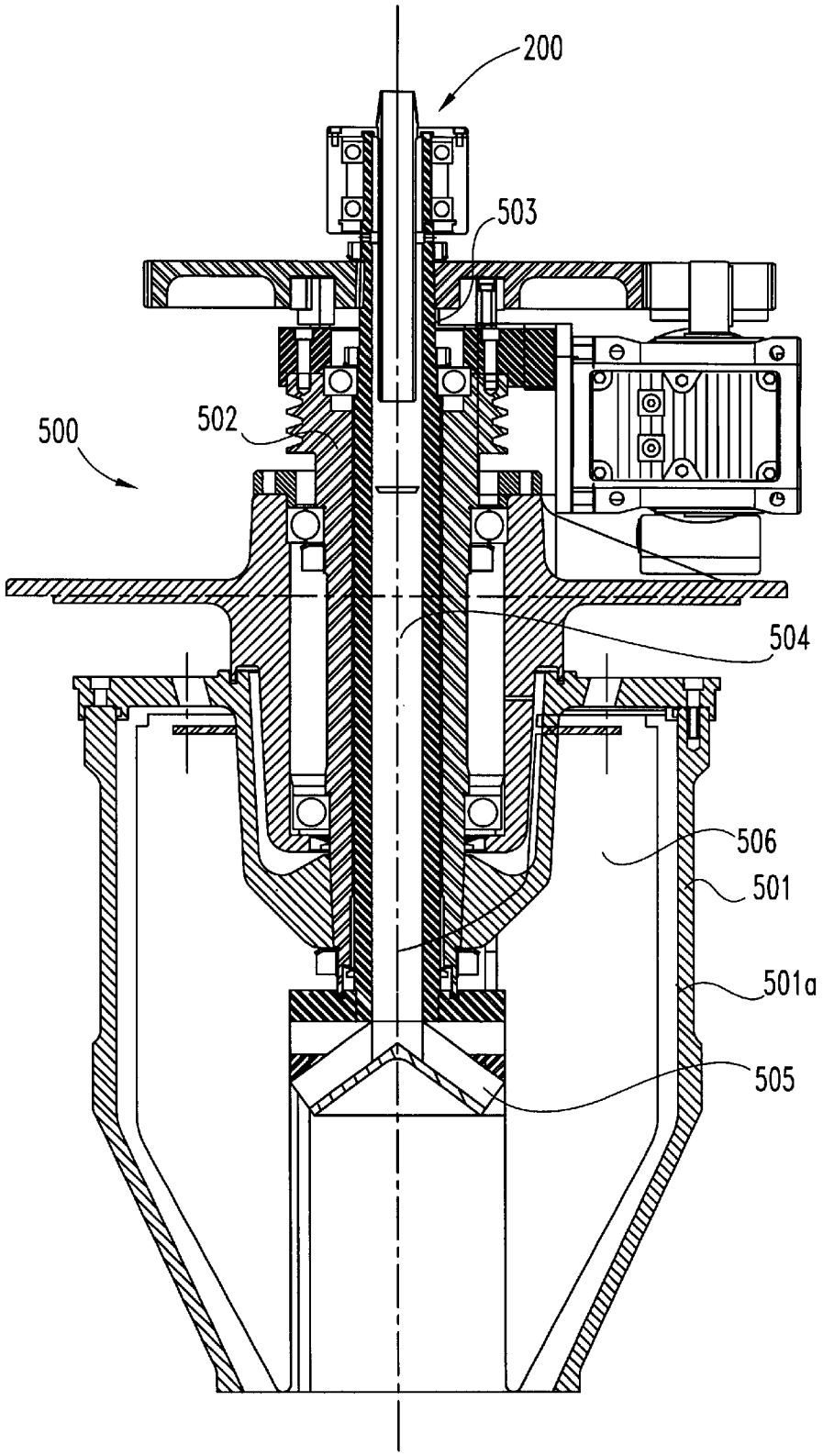
FIG. 7 is a sectional side elevational view of an alternative embodiment of the centrifugal separator comprising a portion of the FIG. 1 centrifugal separator system.

With reference to FIG. 7, there is illustrated an alternative embodiment of the centrifugal separator of the present invention. The centrifugal separator 500 is coupled to a supporting frame 14, which is mounted to tank 15 and includes a discharge chute 120. It is understood herein that the centrifugal separator 500 and the centrifugal separator 10 are substantially similar and like numbers represent like features between the embodiments. A bowl 501 is coupled to a main drive spindle 502, which is driven by the drive belt 152. Disposed within the main drive spindle 502 is a plow blade drive shaft 503. The plow blade drive shaft 503 has self-centering feed tube assembly 200 coupled thereto. The combination of solid and liquid material is passed through the feed tube assembly 200 into the passageway 504 and discharged from a bottom feed impeller 505. The bottom feed impeller 505 disperses the combination of liquid and solid into the central region of the bowl 501 for separation during the high-speed separation mode.

During the separation mode, the solid materials adhere to the inner wall 501*a* of the bowl 501. Thereafter, during the cleaning cycle the plow blade assembly 506 is rotated to remove the accumulated solids from the bowl. In one embodiment, the plow blade assembly 506 has a plurality of individual plow blades coupled in a tangential relation to the outer diameter of the plow blade drive shaft 503. The tangential relationship of the plow blades 506 to the inner surface 501*a* of bowl 501 is substantially similar to the tangential plow blades disclosed for centrifugal separator 10. More specifically, in one embodiment of centrifugal separator 500 there are four tangential plow blades oriented in a tangential relationship to the outer diameter of the plow blade drive shaft 55 to cause an angle $\alpha$ to be formed between each blade and the wall of the bowl. The angle $\alpha$ is less than 90°.

The plow motor drive mechanism being substantially identical to the plow motor drive mechanism for the centrifugal separator 10. The centrifugal separator 500 including the means for allowing the relative movement between the bowl and the plow blades of centrifugal separator 10. More specifically, the features related to the bumper ring 90 and the engaging element 104 are utilized.

Having described at least one embodiment of the present invention the operation and control of a centrifugal separator will be described with reference to FIGS. 1–7. The centrifugal separator 10 processes the combination of material in a cycle that includes a high-speed separation portion and a cleaning or solid material discharging mode. The centrifugal separator is preferably run until substantially full of solids thereby increasing the efficiency of the machine cycle. The separation portion of the run cycle is brought to completion and the plow blade assembly 60 is actuated to dislodge any solids accumulated on the bowl wall. During the separation portion, a combination of material is passed through the feed tube assembly 200 into the aperture through the plow blade drive shaft 55 and out through the aperture(s) 62 formed in the directing member/dam ring/feed impeller 59. Thereafter, the material is dispersed by centrifugal forces outwardly towards the bowl wall. The substantially pure liquid portion being discharged through opening 130 into tank 15. Upon reaching a sufficient quantity of material within the bowl 42, the cleaning cycle is commenced to dislodge the substantially solid portion from the inner wall of the bowl 42. Upon pivoting the plow motor 100 into position, the first gear 65 is engaged by the second gear 66 to cause rotation of the plow blade assembly 60. One of the bumpers 92 strikes the engagement member 104 thereby forming a locking engagement to prevent the main drive spindle 30 and bowl 42 from further substantial rotation in that direction. Thereafter, the plow blade assembly 60 rotates the blades to dislodge the solid adhered to the inner surface of the bowl 42. Next, the controller 12 reverses the rotation direction of the plow motor 100, which reverses the rotation direction of the plow blade assembly 60. The bumper ring 90 will rotate with the plow blade assembly 60 until another bumper 92, which is adjacent to the bumper 92 that had previously engaged the engagement member 104, engages the engagement member 104. This prevents further rotation of the drive spindle 30 and bowl 42 in that direction. Thereafter, the plow blade assembly 60 rotates the blades to dislodge the solids adhered to the inner surface of the bowl 42. This alternating sequence continues until the bowl 42 has been substantially purged of the separated solids.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A centrifugal separator, comprising:

a bowl for receiving a combination of liquid and solid therein;

a drive spindle coupled to said bowl for rotating said bowl during a separation mode to substantially separate the combination of liquid and solid;

a member disposed within and rotatable relative to said bowl during a cleaning mode for dislodging at least a portion of the solid accumulated therein;

a bumper ring coupled to said drive spindle, wherein said bumper ring includes at least one bumper element protruding therefrom; and a bumper ring-engaging member for engaging said at least one bumper element of said bumper ring during said cleaning mode to prevent substantial rotation of said drive spindle and bowl, wherein said bumper ring-engaging member pivots about a pivot pin coupled to a stationary portion of the centrifugal separator.

2. The separator of claim 1, which further includes a drive motor for driving said member disposed within and rotatable relative to said bowl during said cleaning mode, and which further includes a mounting member for supporting said drive motor and said bumper ring-engaging member.

3. The separator of claim 1, wherein said at least one bumper element has a locking portion which corresponds to the shape of the bumper ring-engaging member.

4. The separator of claim 1, which further includes a frame having said drive spindle rotatably coupled thereto, and wherein said bumper ring-engaging member moves relative to said frame to engage said at least one bumper element of said bumper ring.

5. The separator of claim 1, wherein said at least one bumper element is configured to lockingly engage said bumper ring-engaging member.

6. A centrifugal separator, comprising:

a frame;

a main drive member coupled to said frame, said main drive member rotatable relative to said frame during a separation mode;

a bowl adapted for receiving a combination of liquid and solid therein, said bowl coupled to said main drive member and rotatable therewith during said separation mode to substantially separate the combination of liquid and solid;

a plow blade member disposed within and rotatable relative to said bowl, said plow blade member rotatable relative to said bowl during a cleaning mode;

a first locking member coupled to said main drive member; and a second locking member moveable relative to said first locking member, wherein said second locking member has a first state wherein it does not engage said first locking member and a second state wherein it engages said first locking member and prevents substantial rotation of said main drive members, wherein said second locking member is pivotal relative to said frame.

7. The separator of claim 6, wherein said first locking member includes a plurality of bumper members extending therefrom, at least one of said plurality of bumper members is contactable by said second locking member in said second state.

8. The separator of claim 7:

which further includes a moveable plow motor, said plow motor moveable into a position for imparting rotational movement to said plow blade member during said cleaning mode; and wherein said plurality of bumper members are spaced along a circumference of said first locking member, and wherein said second locking member is moveable along a portion of said circumference between two of said plurality of bumper members prior to engaging said at least one of said plurality of bumpers.

9. The separator of claim 6, wherein said plow blade member is rotatable in a first direction and in a second direction, and wherein said second locking member is pivotal relative to said frame, and further wherein said first locking member includes a plurality of spaced bumper members extending therefrom, at least one of said plurality of bumper members is contactable by a portion of said second locking member in said second state.

10. A centrifugal separator, comprising:

a bowl for receiving a combination of liquid and solid therein;

a drive spindle coupled to said bowl for rotating said bowl during a separation mode to substantially separate the combination of liquid and solid;

a member disposed within and rotatable relative to said bowl during a cleaning mode for dislodging at least a portion of the solid accumulated therein;

a bumper ring coupled to said drive spindle, wherein said bumper ring includes a plurality of spaced bumper elements protruding therefrom;

a bumper ring-engaging member for engaging said at least one bumper element of said bumper ring during said cleaning mode to prevent substantial rotation of said drive spindle and bowl; and a plow motor coupled to said member disposed within and rotatable relative to said bowl during said cleaning mode, and wherein said plurality of spaced bumper elements allowing the bumper ring-engaging member to move relative to the bumper ring a distance so as to allow the plow motor to reach a substantial torque prior to engaging one of said plurality of bumper elements.

11. The separator of claim 10, wherein said plurality of bumper elements defines four bumper elements spaced ninety degrees apart, and wherein each of the bumper elements has a bumper ring-engaging member receiving portion which corresponds to the shape of said bumper ring engaging member.

12. A centrifugal separator, comprising:

a bowl for receiving a combination of liquid and solid therein;

a frame;

a drive spindle coupled to said bowl for rotating said bowl during a separation mode to substantially separate the combination of liquid and solid, said drive spindle is rotatably coupled to said frame;

a member disposed within and rotatable relative to said bowl during a cleaning mode for dislodging at least a portion of the solid accumulated therein, said member includes a plurality of plow blades extending therefrom, at least a portion of said member is disposed within said drive spindle;

a first gear coupled to said member;

a drive motor having a second gear coupled thereto, said drive motor being movable between a first mode wherein said first and second gears do not mesh and a second mode wherein said first and second gears mesh to deliver power from said drive motor and rotate said member;

a bumper ring coupled to said drive spindle, wherein said bumper ring includes at least one bumper element protruding therefrom; and a bumper ring-engaging member for engaging said at least one bumper element of said bumper ring during said cleaning mode to prevent substantial rotation of said drive spindle and bowl.

13. A centrifugal separator, comprising:

a bowl for receiving a combination of liquid and solid therein;

a drive spindle coupled to said bowl for rotating said bowl during a separation mode to substantially separate the combination of liquid and solid;

a member disposed within and rotatable relative to said bowl during a cleaning mode for dislodging at least a portion of the solid accumulated therein;

a bumper ring coupled to said drive spindle, wherein said bumper ring includes at least one bumper element protruding therefrom, said at least one bumper element has at least one substantially concavely curved lateral surface to engage said bumper ring-engaging member; and a bumper ring-engaging member for engaging said at least one bumper element of said bumper ring during said cleaning mode to prevent substantial rotation of said drive spindle and bowl.

14. The separator of claim 13, wherein said at least one bumper element has a pair of substantially concavely curved lateral surfaces to lockingly engage said bumper ring-engaging member.

* * * * *